US007121346B2

(12) United States Patent
Wolff et al.

(10) Patent No.: US 7,121,346 B2
(45) Date of Patent: Oct. 17, 2006

(54) INTERVENTION SPOOL FOR SUBSEA USE

(75) Inventors: Danny K. Wolff, Houston, TX (US); John C. Vicic, Spring, TX (US); William M. Taylor, Houston, TX (US); Mark L. Carter, Houston, TX (US)

(73) Assignee: Cameron International Corporation, Houston, TX (US)

( * ) Notice: Subject to any disclaimer, the term of this patent is extended or adjusted under 35 U.S.C. 154(b) by 256 days.

(21) Appl. No.: 10/715,642

(22) Filed: Nov. 18, 2003

(65) Prior Publication Data

US 2005/0279504 A1 Dec. 22, 2005

(51) Int. Cl.
*E21B 33/35* (2006.01)

(52) U.S. Cl. ..... 166/348; 166/368

(58) Field of Classification Search ..... 166/344, 166/348, 368, 88.4, 89.2
See application file for complete search history.

(56) References Cited

U.S. PATENT DOCUMENTS

| | | | | |
|---|---|---|---|---|
| 5,372,199 | A | 12/1994 | Cegielski et al. | 166/368 |
| 5,544,707 | A | 8/1996 | Hopper et al. | 166/382 |
| 5,992,527 | A | 11/1999 | Garnham et al. | 166/379 |
| 6,039,119 | A | 3/2000 | Hopper et al. | 166/368 |
| 6,357,529 | B1 * | 3/2002 | Kent et al. | 166/344 |
| 6,612,368 | B1 | 9/2003 | Bartlett et al. | |
| 2005/0241821 | A1 * | 11/2005 | Milberger | 166/100 |

FOREIGN PATENT DOCUMENTS

| | | | |
|---|---|---|---|
| EP | 0845577 | * | 6/1998 |
| GB | 2 358 207 | A | 7/2001 |
| GB | 2 397 312 | A | 7/2004 |
| WO | WO 99/18329 | | 4/1999 |

OTHER PUBLICATIONS

United Kingdom Combined Search Report and Examination Report for UK Appln. 0425233.4 dated : Mar. 9, 2005 (pp. 4).

* cited by examiner

*Primary Examiner*—William Neuder
(74) *Attorney, Agent, or Firm*—Peter Bielinski

(57) ABSTRACT

A wellhead assembly for use on a well with a blowout preventer stack having a bore therethrough that utilizes an intervention spool sealingly secured between a horizontal tree and the blowout preventer stack to allow the use of a removable valve package positioned in the intervention spool with valve actuators mounted on the exterior of the intervention spool is disclosed.

21 Claims, 2 Drawing Sheets

INTERVENTION SPOOL FOR SUBSEA USE

BACKGROUND OF THE INVENTION

1. Field of the Invention

This invention relates to a modular spool with a bore therethrough having a removable valve package positioned in the bore. This "intervention spool" eliminates the need for a separate subsea test tree and provides a bore equal in diameter to the blowout preventer stack positioned above. The intervention spool can be used in various forms for performing the functions of other well control components.

The installation of subsea trees for control of oil and gas well production requires the installation of down hole completion equipment that is suspended in a wellhead body or housing at the sea floor. The well is then tested by "unloading", i .e., the well is allowed to flow unimpeded up a riser string to a test separator on a drilling unit at the surface. This drilling unit may take the form of a mobile offshore drilling unit ("MODU") or rig or other type of hull based vessel as a spar or tension leg platform.

It is important that well control be maintained under these circumstances. This well control requires the ability to shut off flow to the surface and provide for a disconnect capability should disconnection of the mobile offshore drilling unit be necessary. The current approach to this need is to utilize a subsea test tree that is an adaptation of a valve package typically used during well appraisal drill stem testing. These subsea test tree designs are self-contained valving arrangements including valves with actuators that are used as part of the running or landing string for the tubing hanger. Such subsea test trees have a number of limitations including the size of the valves, the pressure rating of the valves, the temperature rating of the actuators and valves, the force available for shearing and actuation under high pressure and the allowable minimum internal diameter of the drilling riser.

A solution that eliminates the actuation system from the valve package in its running mode and mounts the actuators on the side of a spool or similar is very desirable to overcome these limitations. Such an intervention spool design allows the valve size to be maximized for a given riser internal diameter, allows the use of sufficiently large actuators for required pressure and shearing forces, allows the actuator components to be removed from the high pressure and high temperature environments and allows control of the valves by a control system external to the riser.

2. Description of Related Art

U.S. Pat. No. 5,372,199 to E. J. Cegielski et al. shows a subsea wellhead in which the production string or the production tree may be removed independently of the other.

A wellhead having a spool tree mounted above the wellhead in place of a conventional Christmas tree is disclosed in U.S. Pat. No. 5,544,707 to H. P. Hopper et al.

International Patent Application Number WO 99/18329 to FMC Corporation shows a slimbore completion system that utilizes a reduced diameter tubing hanger which is arranged and dimensioned to pass through the bore of the riser and blowout preventer.

A wellhead assembly in which an in-line tree with a vertical production bore is landed within a wellhead housing is disclosed in U.S. Pat. No. 5,992,527 to D. Garnham et al.

U.S. Pat. No. 6,039,119 to H. P. Hopper et al. shows a completion system with a spool tree in which a tubing hanger is landed at a predetermined angular orientation and allows monitoring of the production casing annulus pressure.

SUMMARY OF THE INVENTION

The present invention comprises a wellhead assembly for use on a well with a blowout preventer stack having a bore therethrough that utilizes an intervention spool sealingly secured between a horizontal tree and the blowout preventer stack to allow the use of a removable valve package positioned in the intervention spool with valve actuators mounted on the exterior of the intervention spool. In the first embodiment, a wellhead housing with a plurality of casing strings suspended from the wellhead housing and their annuli sealed in the wellhead housing is located on the sea floor. A spool tree is sealingly secured to the upper end of the wellhead housing. The spool tree has a bore therethrough adapted to receive a tubing hanger and seal thereon. The spool tree also has at least one lateral port communicating with a valve sealingly secured to the exterior of the spool tree. The tubing hanger is set at a prearranged angular orientation and has at least one tubing bore therethrough and at least one lateral port connected to the tubing bore. The tubing hanger lateral port is aligned with the lateral port of the spool tree and the tubing hanger has a tubing string suspended from it.

An intervention spool is sealingly secured to the upper end of the wellhead housing and has a bore therethrough adapted to receive a removable valve assembly having a plurality of valves arranged therein. The valves have a bore concentric with the tubing hanger and the valves are operable by a plurality of valve actuators positioned on the exterior of the intervention spool. A conventional blowout preventer stack is positioned above and sealingly secured to the intervention spool with a bore substantially equal to the bore of the intervention spool.

Additional embodiments are shown. A second embodiment utilizes a similar arrangement but utilizes the removable valve assembly for well control during production operations. A third embodiment utilizes an arrangement similar to the previous embodiments but replaces the blowout preventer stack with a landing string or inner production riser inside a drilling riser or outer production riser. A final embodiment utilizes an arrangement similar to the third embodiment but with a single bore high pressure production riser replacing the blowout preventer stack.

A principal object of the present invention is to provide a wellhead system with an intervention spool having a removable valve package that allows the valve size to be maximized for a given riser internal diameter.

Another object of the present invention is to provide an intervention spool having a removable valve package that allows the use of sufficiently large actuators for required pressure and shearing forces.

A further object of the present invention is to provide an intervention spool having a removable valve package that allows the actuator components to be removed from the high pressure and high temperature environments.

A final object of the present invention is to provide an intervention spool having a removable valve package that allows control of the valves by a control system external to the riser.

These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENTS

Figure 1:
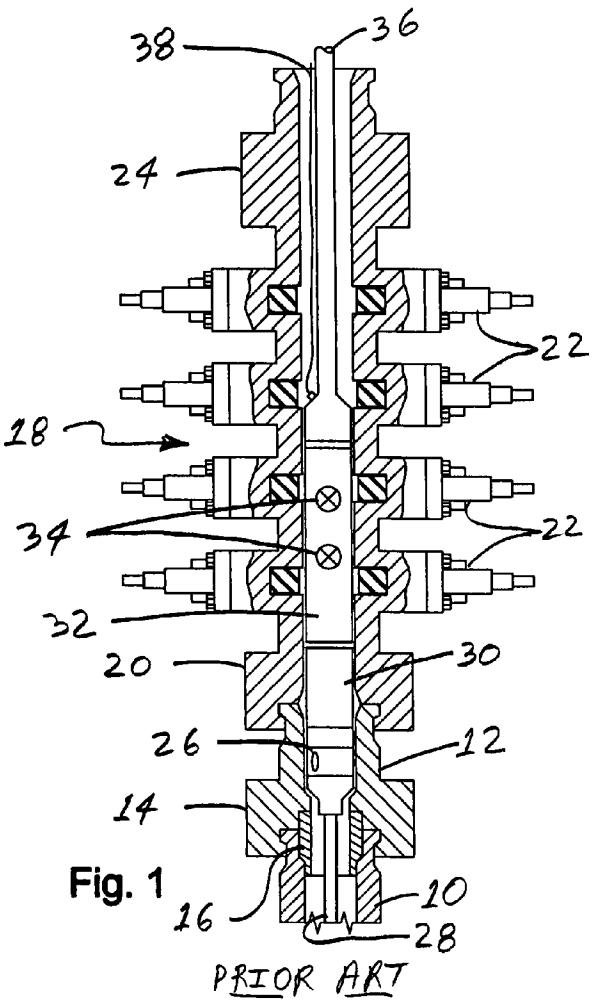
Fig. 1 PRIOR ART
FIG. 1 is an elevation view, partially in section, of a prior art wellhead assembly showing the blowout preventer stack landed directly on a subsea spool tree.

With reference to the drawings, and particularly to FIG. 1, an elevation view, partially in section, of a prior art wellhead assembly is shown. Wellhead housing 10 is positioned at the sea floor with spool tree 12 sealingly secured thereto by a remotely operable connector 14. Wellhead housing 10 has one or more casing strings suspended from it with the casing annuli sealed in wellhead housing 10 in a manner well known to those of ordinary skill in the art. Seal sleeve 16 is secured to spool tree 12 and extends into wellhead housing 10 and seals therein when connector 14 locks spool tree 12 to wellhead housing 10.

Positioned above spool tree 12 is blowout preventer stack 18. Blowout preventer stack 18 includes a remotely operable connector 20 at its lower end that sealing secures blowout preventer stack 18 to spool tree 12. Blowout preventer stack 18 includes a plurality of ram type blowout preventers 22 with a spherical or "bag" type blowout preventer 24 at the top.

Tubing hanger 26 is landed in spool tree 12 and has tubing string 28 suspended therefrom. Tubing hanger running tool 30 is connected to the upper end of tubing hanger 26. A conventional subsea test tree 32 with valves 34 is positioned above tubing hanger running tool 30 and is suspended from landing string 36 to which hydraulic control umbilical 38 is attached. Such an arrangement suffers from such deficiencies as limitation of the size of the valves, the pressure rating of the valves, the temperature rating of the actuators and valves, the force available for shearing and actuation under high pressure and the allowable minimum internal diameter of the drilling riser. Additionally, subsea test tree 32 typically is positioned in blowout preventer stack 18 which prevents closing of ram type blowout preventers 22 in an emergency. The present invention utilizing an intervention spool between the spool tree and blowout preventer stack addresses these deficiencies.

Figure 2:
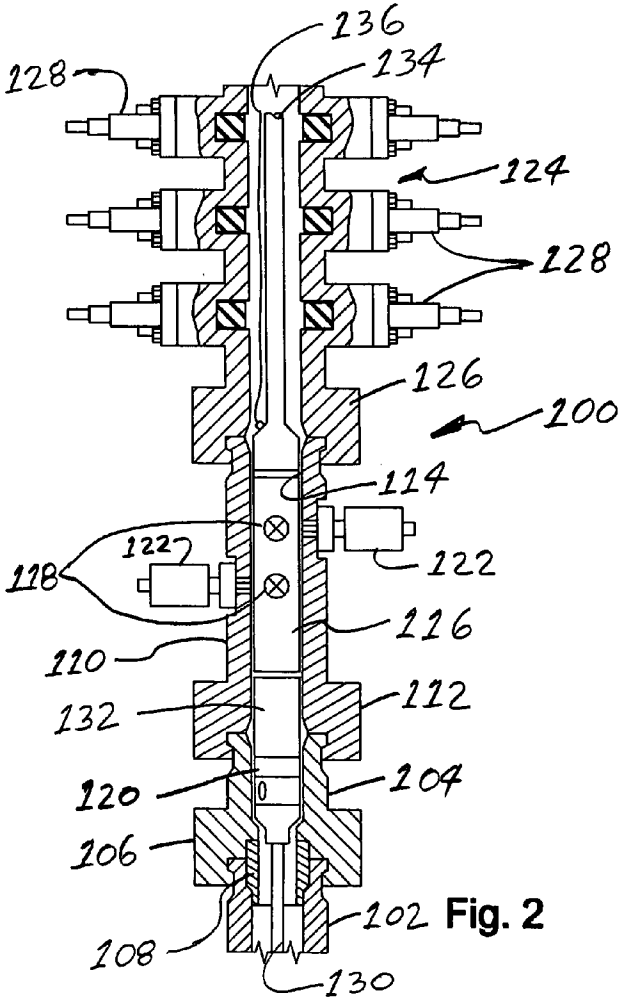
FIG. 2 is an elevation view, partially in section, of the present invention with the intervention spool between the blowout preventer stack and the tubing spool.

Referring to FIG. 2, wellhead assembly 100 embodying the principles of the present invention is shown. Wellhead housing 102 is positioned at the sea floor with spool tree 104 sealingly secured thereto by a remotely operable connector 106. Wellhead housing 102 has one or more casing strings suspended from it with the casing annuli sealed in wellhead housing 102 in a similar manner as shown in FIG. 1. Seal sleeve 108 is secured to spool tree 104 and extends into wellhead housing 102 and seals therein when connector 106 locks spool tree 104 to wellhead housing 102.

Positioned above spool tree 104 is intervention spool 110. Intervention spool 110 includes a remotely operable connector 112 at its lower end that sealing secures intervention spool 110 to spool tree 104. Intervention spool 110 is a generally cylindrical with bore 114 extending therethrough and adapted to receive valve assembly 116 therein. Valve assembly 116 includes valves 118 arranged therein having bores concentric with that of tubing hanger 120 positioned below in spool tree 104. Valves 118 are operated by valve actuators 122 that extend through the wall of intervention spool 110 and are positioned on the exterior of intervention spool 110.

Positioned above spool tree 104 is blowout preventer stack 124 that is substantially the same as blowout preventer stack 18 and includes a remotely operable connector 126 at its lower end that sealingly secures blowout preventer stack 124 to spool tree 104. Blowout preventer stack 124 includes a plurality of ram type blowout preventers 128 positioned as before.

Tubing hanger 120 is landed in spool tree 104 and has tubing string 130 suspended therefrom. Tubing hanger running tool 132 is connected to the upper end of tubing hanger 120. Valve assembly 116 with valves 118 is positioned above tubing hanger running tool 132 and is lowered into position with landing string 134 to which hydraulic control umbilical 136 is attached.

By using intervention spool 110 as shown in FIG. 2, the deficiencies noted earlier are eliminated. Bore 114 of intervention spool 110 is equal to that of blowout preventer stack 124 allowing full bore access to spool tree 104 and tubing hanger 120. Intervention spool 110 also provides an exact spacing between spool tree 104 and blowout preventer stack 124.

Figure 3:
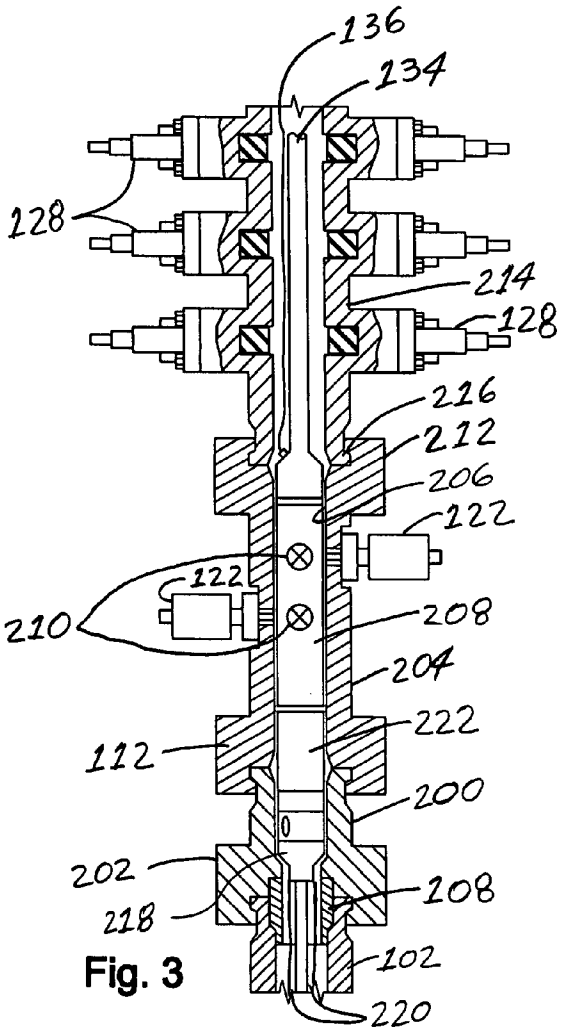
FIG. 3 is an elevation view, partially in section, of another embodiment where the intervention spool valve assembly is used for well control during production operations.

A second embodiment of the present invention is shown in FIG. 3 that allows the use of the removable valve assembly for well control during production operations. Those items which are the same as in the first embodiment retain their numerical designation. Wellhead housing 102 is positioned at the sea floor with spool tree 200 sealingly secured thereto by a remotely operable connector 202. Wellhead housing 102 has one or more casing strings suspended from it with the casing annuli sealed in wellhead housing 102 as in the first embodiment. Seal sleeve 108 is secured to spool tree 200 and extends into wellhead housing 102 and seals therein when connector 202 locks spool tree 200 to wellhead housing 102.

Positioned above spool tree 200 is intervention spool 204. Intervention spool 204 includes a remotely operable connector 112 at its lower end that sealing secures intervention spool 204 to spool tree 200. Intervention spool 204 is a generally cylindrical with bore 206 extending therethrough and adapted to receive valve assembly 208 therein. Valve assembly 208 includes valves 210 arranged therein having bores that are laterally displaced from one another but, concentric with those of tubing hanger 212 positioned below in spool tree 200. Valves 210 are operated by valve actuators 122 that extend through the wall of intervention spool 204 and are positioned on the exterior of intervention spool 204. Intervention spool 204 has remotely operable connector 212 at its upper end that sealingly secures intervention spool 204 to blowout preventer stack 214 positioned above.

Blowout preventer stack 214 is substantially the same as blowout preventer stack 124 except for hub profile 216 at its lower end that remotely operable connector 212 locks onto to sealingly secure blowout preventer stack 214 to spool tree 200. Blowout preventer stack 214 includes a plurality of ram type blowout preventers 128 positioned as before.

Tubing hanger 218 is landed in spool tree 200 and has tubing strings 220 suspended therefrom. Tubing hanger running tool 222 is connected to the upper end of tubing hanger 218. Valve assembly 208 with valves 210 is positioned above tubing hanger running tool 222 and is lowered into position with landing string 134 to which hydraulic control umbilical 136 is attached.

As in the first embodiment bore 206 of intervention spool 200 is equal to that of blowout preventer stack 214 allowing full bore access to spool tree 200 and tubing hanger 218. Valve assembly 208 has multiple bores aligned with the multiple bores of tubing hanger 218 to allow for multiple production zones. Additionally, valves 210 are left in place after testing operations and used for well control during oil and gas production operations.

Figure 4:
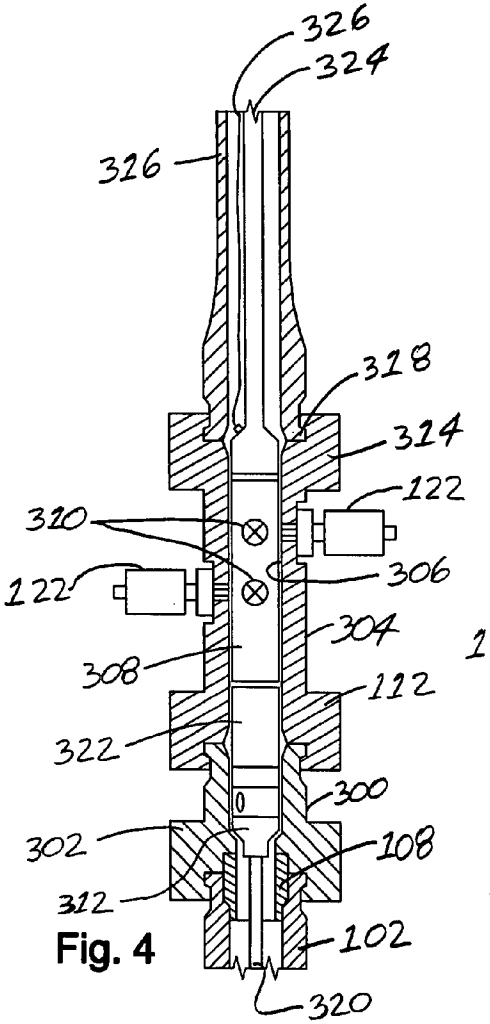
FIG. 4 is an elevation view, partially in section, of another embodiment where a production riser is connected directly to the valve assembly of the intervention spool.

A third embodiment of the present invention is shown in FIG. 4 that uses a drilling riser or outer production riser surrounding an inner production riser or landing string in place of the blowout preventer stack of the previous embodiments. Those items which are the same as in the previous embodiments retain their numerical designation.

Wellhead housing 102 is positioned at the sea floor with spool tree 300 sealingly secured thereto by a remotely operable connector 302. Wellhead housing 102 has one or more casing strings suspended from it with the casing annuli sealed in wellhead housing 102 as in the previous embodiments. Seal sleeve 108 is secured to spool tree 300 and extends into wellhead housing 102 and seals therein when connector 302 locks spool tree 300 to wellhead housing 102.

Positioned above spool tree 300 is intervention spool 304. Intervention spool 304 includes a remotely operable connector 112 at its lower end that sealing secures intervention spool 304 to spool tree 300. Intervention spool 304 is a generally cylindrical with bore 306 extending therethrough and adapted to receive valve assembly 308 therein. Valve assembly 308 includes valves 310 arranged therein having bores concentric with that of tubing hanger 312 positioned below in spool tree 304. Valves 310 are operated by valve actuators 122 that extend through the wall of intervention spool 304 and are positioned on the exterior of intervention spool 304. Intervention spool 304 has remotely operable connector 314 at its upper end that sealingly secures intervention spool 304 to drilling riser or outer production riser 316 positioned above.

Drilling riser or outer production riser 316 has a bore substantially equal to that of bore 306 of intervention spool 304 and hub profile 318 at its lower end that remotely operable connector 314 locks onto to sealingly secure drilling riser or outer production riser 316 to intervention spool 304. Tubing hanger 312 is landed in spool tree 300 and has tubing string 320 suspended therefrom. Tubing hanger running tool 322 is connected to the upper end of tubing hanger 312. Valve assembly 308 with valves 310 is positioned above tubing hanger running tool 322 and is lowered into position with landing string or inner production riser 324 to which hydraulic control umbilical 326 is attached.

Figure 5:
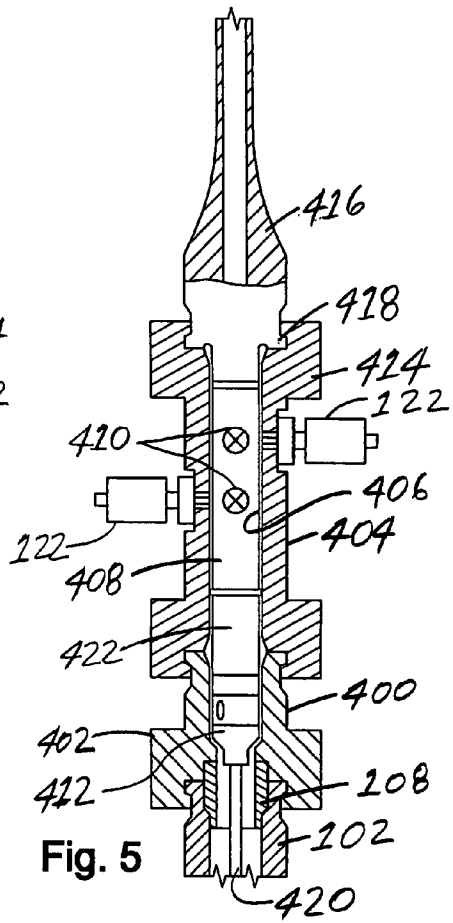
FIG. 5 is an elevation view, partially in section, of another embodiment where a production riser is connected directly to the intervention spool.

A fourth embodiment of the present invention is shown in FIG. 5 that uses a high pressure production riser that can be removed and a drilling riser installed for removal of the removable valve package. Those items which are the same as in the previous embodiments retain their numerical designation. Wellhead housing 102 is positioned at the sea floor with spool tree 400 sealingly secured thereto by a remotely operable connector 402. Wellhead housing 102 has one or more casing strings suspended from it with the casing annuli sealed in wellhead housing 102 as in the previous embodiments. Seal sleeve 108 is secured to spool tree 400 and extends into wellhead housing 102 and seals therein when connector 402 locks spool tree 400 to wellhead housing 102.

Positioned above spool tree 400 is intervention spool 404. Intervention spool 404 includes a remotely operable connector 112 at its lower end that sealing secures intervention spool 404 to spool tree 400. Intervention spool 404 is a generally cylindrical with bore 406 extending therethrough and adapted to receive valve assembly 408 therein. Valve assembly 408 includes valves 410 arranged therein having bores concentric with that of tubing hanger 412 positioned below in spool tree 400. Valves 410 are operated by valve actuators 122 that extend through the wall of intervention spool 404 and are positioned on the exterior of intervention spool 404. Intervention spool 404 has remotely operable connector 414 at its upper end that sealingly secures intervention spool 404 to high pressure production riser 416 positioned above.

High pressure production riser 416 has hub profile 418 at its lower end that remotely operable connector 414 locks onto to sealingly secure high pressure production riser 416 to intervention spool 404. Tubing hanger 412 is landed in spool tree 400 and has tubing string 420 suspended therefrom. Tubing hanger running tool 422 is connected to the upper end of tubing hanger 412.

The construction of our intervention spool will be readily understood from the foregoing description and it will be seen that we have provided an intervention spool having a removable valve package that allows the valve size to be maximized for a given riser internal diameter. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. A wellhead assembly for use on a well with a blowout preventer stack having a bore therethrough, comprising:

a wellhead housing, said wellhead housing adapted to suspend at least one casing string therein, and seal an annulus between said wellhead housing and said at least one casing string;

a spool tree sealingly secured to an upper end of said wellhead housing, said spool tree having a bore therethrough adapted to receive a tubing hanger therein and seal thereabout;

a tubing hanger sealingly secured within said spool tree at a prearranged angular orientation, said tubing hanger having at least one tubing bore therethrough, said tubing hanger having a tubing string suspended therefrom;

an intervention spool sealingly secured to the upper end of said spool tree, said intervention spool having a bore therethrough adapted to receive a valve assembly having a plurality of valves arranged therein, said valves having a bore concentric with said tubing hanger, said valve assembly valves being operable, with the blowout preventer stack in place, by a plurality of valve actuators positioned on the exterior of said intervention spool; and, a blowout preventer stack positioned above and sealingly secured to said intervention spool, said blowout stack having a bore substantially equal to the bore of said intervention spool.

2. A wellhead assembly for use on a well with a blowout preventer stack having a bore therethrough according to claim 1, further comprising:

a landing string attached to said valve assembly for lowering said valve assembly into said intervention spool; and, an umbilical line attached to said valve assembly.

3. A wellhead assembly for use on a well with a blowout preventer stack having a bore therethrough according to claim 2, further comprising:

a seal sleeve sealingly secured to the lower end of said spool tree, said seal sleeve extending into said wellhead housing and sealing said wellhead to casing annulus when said spool tree is secured to said wellhead housing.

4. A wellhead assembly for use on a well with a blowout preventer stack having a bore according to claim 3, wherein:

said tubing hanger includes a plurality of tubing bores therethrough, said tubing bores laterally displaced from one another and axially aligned with a plurality of tubing strings suspended from said tubing hanger;

said intervention spool valve assembly having a plurality of bores therethrough, said plurality of bores aligned with said tubing hanger bores, said intervention spool valve assembly plurality of valves arranged to form at least one closure member for each of said bores, said valve assembly valves being operable by a plurality of valve actuators positioned on the exterior of said intervention spool.

5. An apparatus for use on a well with a blowout preventer stack having a bore therethrough to selectively control the flow of fluids from said well, comprising:

a wellhead housing, said wellhead housing adapted to suspend at least one casing string therein, and seal an annulus between said wellhead housing and said at least one casing string;

a spool tree sealingly secured to an upper end of said wellhead housing, said spool tree having a bore therethrough adapted to receive a tubing hanger therein and seal thereabout;

a tubing hanger sealingly secured within said spool tree at a prearranged angular orientation, said tubing hanger having at least one tubing bore therethrough, said tubing hanger having a tubing string suspended therefrom;

an intervention spool sealingly secured to the upper end of said spool tree, said intervention spool having a bore therethrough adapted to receive a valve assembly having a plurality of valves arranged therein, said valves having a bore concentric with said tubing hanger, said valve assembly valves being operable by a plurality of valve actuators positioned on the exterior of said intervention spool to selectively control well production fluid flow therethrough; and, a blowout preventer stack positioned above said intervention spool, said blowout stack having a bore substantially equal to the bore of said intervention spool, said blowout preventer stack having a hub formed on its lower end; and, said intervention spool having a remotely operable connector on its upper end for sealing engagement with said hub of said blowout preventer stack.

6. An apparatus for use on a well with a blowout preventer stack having a bore therethrough to selectively control the flow of fluids from said well, according to claim 5, further comprising:

a landing string attached to said valve assembly for lowering said valve assembly into said intervention spool; and, an umbilical line attached to said valve assembly.

7. An apparatus for use on a well with a blowout preventer stack having a bore therethrough to selectively control the flow of fluids from said well, according to claim 6, further comprising:

a seal sleeve sealingly secured to the lower end of said spool tire, said seal sleeve extending into said wellhead housing and sealing said wellhead to casing annulus when said spool tree is secured to said wellhead housing.

8. An apparatus for use on a well with a blowout preventer stack having a bore therethrough to selectively control the flow of fluids from said well, according to claim 7, further comprising:

said tubing hanger includes a plurality of tubing bores therethrough, said tubing bores laterally displaced from one another and axially aligned with a plurality of tubing strings suspended from said tubing hanger;

a tubing hanger adapter positioned above said tubing hanger, said tubing hanger adapter having a plurality of bores therethrough, said plurality of tubing hanger adapter bores aligned with said tubing hanger bores and sealed thereto;

said intervention spool valve assembly having a plurality of bores thererhrough, said plurality of bores aligned with said tubing hanger bores and said tubing hanger adapter bores, and sealed to said tubing hanger adapter bores, said intervention spool valve assembly plurality of valves arranged to form at least one closure member for each of said bores, said valve assembly valves being operable by a plurality of valve actuators positioned on the exterior of said intervention spool.

9. An apparatus for use on a well to selectively control the flow of fluids from said well, comprising:

a wellhead housing, said wellhead housing adapted to suspend at least one casing string therein, and seal an annulus between said wellhead housing and said at least one casing string;

a spool tree sealingly secured to an upper end of said wellhead housing, said spool tree having a bore therethrough adapted to receive a tubing hanger therein and seal thereabout;

a tubing hanger sealingly secured within said spool tree at a prearranged angular orientation, said tubing hanger having at least one tubing bore therethrough, said tubing hanger having a tubing string suspended therefrom;

an intervention spool sealingly secured to the upper end of said spool tree wellhead housing, said intervention spool having a bore therethrough adapted to receive a valve assembly having a plurality of valves arranged therein, said valves having a bore concentric with said tubing hanger, said valve assembly valves being operable by a plurality of valve actuators positioned on the exterior of said intervention spool to selectively control well production fluid flow therethrough; and, a riser positioned above said intervention spool, said riser having a bore substantially equal to the bore of said intervention spool, said riser having a hub formed on its lower end; and, said intervention spool having a remotely operable connector on its upper end for sealing engagement with said hub of said riser.

10. An apparatus for use on a well to selectively control the flow of fluids from said well, according to claim 9, further comprising:

a landing string attached to said valve assembly for lowering said valve assembly into said intervention spool; and, an umbilical line attached to said valve assembly.

11. An apparatus for use on a well to selectively control the flow of fluids from said well, according to claim 10, further comprising:

a seal sleeve sealingly secured to the lower end of said spool tree, said seal sleeve extending into said wellhead housing and sealing said wellhead to casing annulus when said spool tree is secured to said wellhead housing.

12. An apparatus for use on a well therethrough to selectively control the flow of fluids from said well, comprising:

a wellhead housing, said wellhead housing adapted to suspend at least one casing string therein, and seal an annulus between said wellhead housing and said at least one casing string;

a spool tree sealingly secured to an upper end of said wellhead housing, said spool tree having a bore therethrough adapted to receive a tubing hanger therein and seal thereabout;

a tubing hanger sealingly secured within said spool tree at a prearranged angular orientation, said tubing hanger having at least one tubing bore therethrough, said tubing hanger having a tubing string suspended therefrom;

an intervention spool sealingly secured to the upper end of said spool tree, said intervention spool having a bore therethrough adapted to receive a valve assembly having a plurality of valves arranged therein, said valves having a bore concentric with said tubing hanger, said valve assembly valves being operable by a plurality of valve actuators positioned on the exterior of said intervention spool to selectively control well production fluid flow therethrough; and, a production riser positioned above said intervention spool, said riser having a bore substantially equal to the bore of said tubing hanger, said production riser having a hub formed on its lower end; and, said intervention spool having a remotely operable connector on its upper end for sealing engagement with said hub of said production riser.

13. An apparatus for use on a well to selectively control the flow of fluids from said well, according to claim 12, further comprising:

a landing string attached to said valve assembly for lowering said valve assembly into said intervention spool; and, an umbilical line attached to said valve assembly.

14. An apparatus for use on a well to selectively control the flow of fluids from said well, according to claim 13, further comprising:

a seal sleeve sealingly secured to the lower end of said spool tree, said seal sleeve extending into said wellhead housing and sealing said wellhead to casing annulus when said spool tree is secured to said wellhead housing.

15. A flow control assembly for a wellhead, comprising:

a spool tree mounted to the wellhead;

one of a blowout preventer assembly and a riser supported by said spool tree; and a valve assembly selectively supported by said spool tree and, in operation, disposed outside of said blowout preventer or riser assembly; and an intervention spool between said spool tree and said blowout preventer assembly or riser.

16. The assembly of claim 15, comprising:

said valve assembly mounted within said intervention spool.

17. The assembly of claim 15, comprising:

an operator for said valve assembly that is powered externally to said blowout preventer assembly or riser.

18. The assembly of claim 15, comprising:

a blowout preventer assembly; and a string that extends through said blowout preventer assembly in a manner to allow shear rams in said blowout preventer assembly to cut said string while avoiding said valve assembly.

19. The assembly of claim 18, comprising:

said valve assembly does not need to be moved to allow said shear rams to shear said string.

20. The assembly of claim 15, wherein:

only a riser is supported by said intervention spool.

21. The assembly of claim 15, wherein:

said valve assembly operable from an actuator mounted through said intervention spool.

* * * * *